US009261842B2

(12) United States Patent
Nakagawa et al.

(10) Patent No.: US 9,261,842 B2
(45) Date of Patent: Feb. 16, 2016

(54) IMAGE FORMING APPARATUS, DENSITY DETECTING APPARATUS, AND DENSITY DETECTING METHOD

(71) Applicant: CANON KABUSHIKI KAISHA, Tokyo (JP)

(72) Inventors: Ken Nakagawa, Yokohama (JP); Shinsuke Kobayashi, Yokohama (JP); Keisuke Ishizumi, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/311,702

(22) Filed: Jun. 23, 2014

(65) Prior Publication Data

US 2015/0003853 A1 Jan. 1, 2015

(30) Foreign Application Priority Data

Jun. 26, 2013 (JP) ..... 2013-133532

(51) Int. Cl.
*G03G 15/00* (2006.01)

(52) U.S. Cl.
CPC .... *G03G 15/5058* (2013.01); *G03G 2215/0132* (2013.01); *G03G 2215/0164* (2013.01)

(58) Field of Classification Search
CPC ..... G03G 15/5033; G03G 15/5041
USPC ..... 399/49, 71
See application file for complete search history.

(56) References Cited

U.S. PATENT DOCUMENTS

2011/0103815 A1* 5/2011 Hanashi ..... 399/49

FOREIGN PATENT DOCUMENTS

| | | | |
|---|---|---|---|
| JP | 2003-050493 | A | 2/2003 |
| JP | 2006-139179 | A | 6/2006 |
| JP | 2006-145679 | A | 6/2006 |
| JP | 2009-103924 | A | 5/2009 |
| JP | 2011-242441 | A | 12/2011 |
| JP | 2012-027140 | A | 2/2012 |

* cited by examiner

*Primary Examiner* — Hoang Ngo
(74) *Attorney, Agent, or Firm* — Canon U.S.A., Inc. IP Division

(57) ABSTRACT

Provided are a first detecting unit having a singular first light-receiving element disposed to face a direction of normal reflection of light, the light having been emitted from a first light-emitting element toward a first detection image formed on the rotary member and reflected thereat, and a second detecting unit having a singular second light-receiving element disposed to face a direction different from a direction of normal reflection of light, the light having been emitted from a second light-emitting element toward a second detection image formed on the rotary member and reflected thereat. A value relating to toner density is obtained based on a first detection result detected by the first detecting unit and a second detection result detected by the second detecting unit.

24 Claims, 12 Drawing Sheets

IMAGE FORMING APPARATUS, DENSITY DETECTING APPARATUS, AND DENSITY DETECTING METHOD

BACKGROUND OF THE INVENTION

1. Field of the Invention

The present invention relates to primarily an image forming apparatus such as an electrophotography type or electrostatic storage type image forming apparatus such as a copier or printer, which performs density correction of images. The present invention also relates to a density detecting device and density detecting method for detecting density of images.

2. Description of the Related Art

There has been demand for improved stability of image quality in image forming apparatuses which form color images. To deal with this demand, density correction control is performed to correct change in density due to various factors. These factors include secular change in driving members and image forming members of the image forming apparatus from continuous use, change in the environment where the image forming apparatus is installed, change in temperature within the image forming apparatus, and so forth.

An example of density control is disclosed in Japanese Patent Laid-Open No. 2006-145679, where a toner image for density control (hereinafter referred to as "test image") is formed on a rotation member such as an intermediate transfer belt. The formed test image is detected by a detecting device, configured including a light emitting portion, a light receiving portion which receives normal reflection light that has been irradiated from the light emitting portion, and a light receiving portion which receives diffused reflection light that has been irradiated from the light emitting portion. The detection results detected at the detecting device are used to correct density, by controlling the amount of exposure at the time of forming a latent image, the area ratio when forming the latent image, charging voltage, developing voltage, and so forth, so that the density will be appropriate when forming an image.

However, depending on the state of the image forming apparatus, there may be difference in density according to the position in the main scanning direction of image formation (the longitudinal direction orthogonal to the rotational (circumferential) direction of an image bearing member). This is due to, for example, difference in contact pressure between the developing roller and developer blade in the main scanning direction, variance in photosensitivity and/or surface potential of the photosensitive drum in the main scanning direction, and so forth. Such variance might be able to be handled by forming test images of the same tone at multiple positions in the main scanning direction for example, and averaging the detection results.

However, suppressing variance in this way necessitates sensors to serve as multiple detecting devices to form multiple test images. While the precision of density correction control can be improved by averaging the detection results of the multiple test images, the number of sensors increases as the number of test images increases, so there has been a problem of increased costs.

SUMMARY OF THE INVENTION

It has been found desirable to suppress increase in costs while improving the precision of density correction control.

Provided are a rotary member, an image forming unit configured to form a plurality of detection images, which are toner images, on the rotary member, a first detecting unit having a singular first light-receiving element disposed to face a direction of normal reflection of light, the light having been emitted from a first light-emitting element toward a first detection image formed on the rotary member and reflected thereat, a second detecting unit having a singular second light-receiving element disposed to face a direction different from a direction of normal reflection of light, the light having been emitted from a second light-emitting element toward a second detection image formed on the rotary member and reflected thereat, and a control unit configured to obtain a value relating to toner density based on a first detection result detected by the first detecting unit and a second detection result detected by the second detecting unit.

Further features of the present invention will become apparent from the following description of exemplary embodiments with reference to the attached drawings.

DESCRIPTION OF THE EMBODIMENTS

Hereafter, the embodiments of the present invention will be described with reference to the drawings. The following embodiments do not limit the scope of the present invention, and all combinations of the features described by the embodiments are not necessarily required.

First Embodiment

Description of the Image Forming Apparatus

Figure 1:
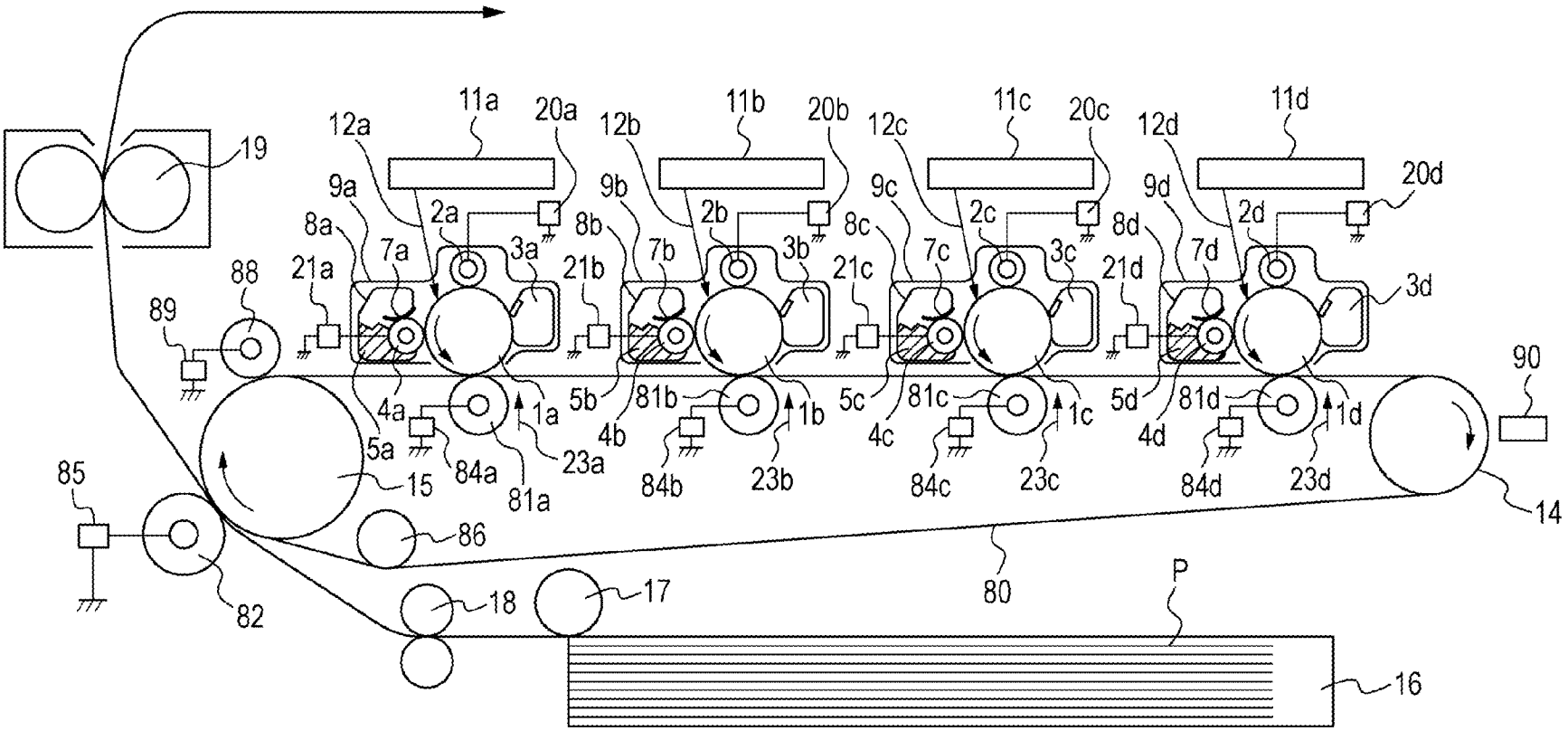
FIG. 1 is a schematic configuration diagram of an image forming apparatus.

FIG. 1 is a schematic configuration diagram of the image forming apparatus. The image forming apparatus described in the present embodiment uses a first station as a yellow (Y) toner image forming station, a second station as a magenta (M) toner image forming station, a third station as a cyan (C) toner image forming station, and a fourth station as a black (K) toner image forming station. Members illustrated in the drawings which have the letters a, b, c, or d appended thereto represent members which form yellow, magenta, cyan, and black toner images, respectively, on an intermediate transfer belt 80. However, if there is there is no necessity to distinguish between the colors in the following description, reference numerals will be used without the letters a, b, c, or d appended thereto.

First, one of the four stations, the first station, will be described. The stations are all the same in configuration, so the appended letters will be omitted in this description. A photosensitive drum 1, serving as an image bearing member, is formed including a carrier formation layer, which generates charges due to a photosensitive nature thereof, formed upon a metal cylinder, a charge transporting layer which transports generated charges, and so forth, in a configuration where multiple layers of functional organic materials are laminated. The outermost layer has low conductivity, almost to the point of being an insulator. A charging roller 2 serving as a charging device is in contact with the photosensitive drum 1. The charging roller 2 rotates following the rotation of the photosensitive drum 1, and in doing so uniformly charges the surface of the photosensitive drum 1. Voltage, on which direct current (DC) voltage or alternating current (AC) voltage has been superimposed, is applied to the charging roller 2. The photosensitive drum 1 is charged by discharge occurring at a minute air gap upstream and downstream of the contact nip between the charging roller 2 and the surface of the photosensitive drum 1.

A cleaning unit 3 cleans residual toner off the photosensitive drum 1. A developing unit 8 serving as a developing device includes a developing roller 4, non-magnetic single-component toner 5, a developer applying blade 7, and develops electrostatic latent images formed on the photosensitive drum 1. The members denoted by the reference numerals 1 through 8 make up an integrated process cartridge 9 which is detachably mounted to the image forming apparatus. A exposing device 11 is configured including a scanner unit or light-emitting diode (LED) array whereby a polygonal mirror is scanned with a laser beam, and irradiates exposure light 12, which has been modulated according to image signals, onto the photosensitive drum 1.

The charging roller 2 is connected to a charging bias power source 20 serving as a voltage supply unit to the charging roller 2. The developing roller 4 is connected to a developing bias power source 21 which is a voltage supply unit to the developing roller 4. A primary transfer roller 81 is connected to a primary transfer bias power source 84 which is a voltage supply device to the primary transfer roller 81. The first station is configured thusly, and the second, third, and fourth stations are of like configurations. Members which are of the same function as in the first station are denoted by the same reference numerals, followed by the letters b, c, and d, indicating the station, instead of a for the first station.

The intermediate transfer belt 80 is supported by three rollers serving as stretching members, namely, a secondary transfer opposing roller 15, a tension roller 14, and an assisting roller 86. The tension roller 14 is biased springs in the direction of tensioning the intermediate transfer belt 80, so that an appropriate tensioning force is maintained on the intermediate transfer belt 80. The secondary transfer opposing roller 15 rotationally drives under driving force from a driving source, so that the intermediate transfer belt 80 tensioned on the outer periphery of the secondary transfer opposing roller 15 runs being driven by this rotational driving. The intermediate transfer belt 80 moves in the forward direction of the photosensitive drum 1, indicated by arrows inscribed in the drums, at generally the same speed. The primary transfer roller 81 is disposed across the intermediate transfer belt 80 from the photosensitive drum 1, and rotates following the movement of the intermediate transfer belt 80. A detector 90 serving as a detecting device is positioned facing the tension roller 14, and performs detection by irradiating light on a test image formed on the intermediate transfer belt 80 and receiving reflected light. The detector 90 includes a later-described sensor L208 and sensor R212.

A destaticizing member 23 is disposed downstream from the primary transfer roller 81 in the direction of travel of the intermediate transfer belt 80. The assisting roller 86, tension roller 14, secondary transfer opposing roller 15, and destaticizing member 23 are electrically grounded. Primary transfer rollers 81 and destaticizing members 23 of the same configuration are also provided to the second, third, and fourth stations. Members which are the same as in the first stations are denoted by the same reference numerals, followed by the letters b, c, and d, indicating the station, instead of a for the first station.

Next, image forming operations will be described. Upon receiving a print command when in a standby state, the image forming operations start. The photosensitive drum 1 and intermediate transfer belt 80 begin to turn in the directions indicated by the arrows, at a predetermined process speed. The photosensitive drum 1 is uniformly charged by the charging roller 2. The surface of the charged photosensitive drum 1 is scanned by exposure light from the exposing device 11, thereby forming an electrostatic latent image according to image information. The rate at which the exposing device 11 is emitting per unit time (lit rate) is called area coverage modulation, and changing the coverage modulation changes image density.

Toner 5 within the developing unit 8 is charged to a negative polarity by the developer applying blade 7, and applied to the developing roller 4. The developing roller 4 is then supplied with bias of −300 V from the developing bias power source 21. As the photosensitive drum 1 rotates and the electrostatic latent image formed on the photosensitive drum 1 reaches the developing roller 4, electrostatic latent image is visualized by the negatively-polarized toner, and so a Y toner image is formed at the first station. The second station forms an M toner image, the third station forms a C toner image, and the fourth station forms a K toner image. A controller outputs image write start signals to each of the stations, with time delay for each color according to the distances between the primary transfer positions. Delayed write start signals allow a multi-toner image to be formed on the intermediate transfer belt 80 as the toner images formed on the photosensitive drums 1 are transferred onto the intermediate transfer belt 80 by the primary transfer roller 81 in order. Note that the primary transfer roller 81 is applied with a DC bias of opposite polarity as the toner image.

As the toner image is being formed, a recording material P is conveyed. The recording material P stacked in a cassette 16 is picked up by a feed roller 17, and conveyed to a registration roller 18 by conveyance rollers. The recording material P is conveyed by the registration roller 18 to a secondary transfer portion, which is the nip of the intermediate transfer belt 80 and a secondary transfer roller 82, synchronously with the toner image formed on the intermediate transfer belt 80. A secondary transfer bias power source 85 applies to the secondary transfer roller 82 a bias of opposite polarity as to that of the toner image, thereby performing secondary transfer of the four-color multiple toner image formed on the intermediate transfer belt 80, onto the recording material P. After the secondary transfer, the residual toner remaining on the intermediate transfer belt 80 is charged by a residual toner charging roller 88 disposed so as to come into contact with the intermediate transfer belt 80. The residual toner thus charged is transferred from the intermediate transfer belt 80 to the photosensitive drum 1, and collected at a waste toner container.

The toner image which has been transferred to the recording material P by the secondary transfer is conveyed to a fixing unit 19 serving as a fixing device. The toner image is fused onto the recording material P by heating and compression at the fixing unit 19. This recording material P is then discharged from the image forming apparatus.

Description of Control Block Diagram

Figure 2:
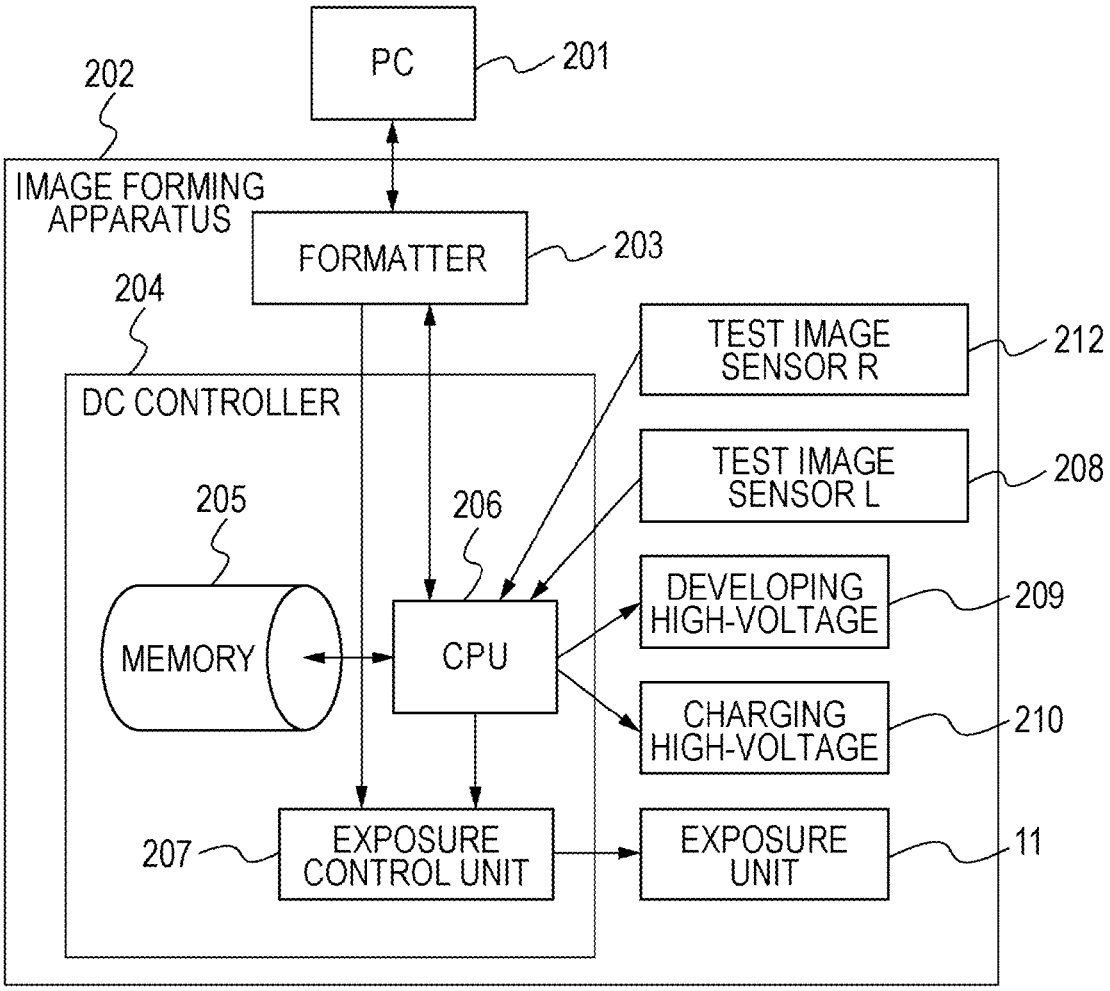
FIG. 2 is a control block diagram illustrating control of operations of the image forming apparatus.

FIG. 2 is a control block diagram illustrating control of operation of the image forming apparatus. A personal computer (PC) 201 serving as a host computer outputs a print command to a formatter 203 within the image forming apparatus 202, and transmits image data of a print image to the formatter 203. The formatter 203 converts the image data received from the PC 201 into exposure data, and transfers to an exposure control unit 207 within a DC controller 204. The exposure control unit 207 performs on/off control of the exposure light 12 emitted from the exposing device 11, based on the exposure data, under control of the CPU 206.

Upon receiving the print command from the formatter 203, the CPU 206 starts an image forming sequence. The DC controller 204 includes the CPU 206, memory 205, and so forth, and performs preprogrammed operations. The CPU 206 controls a charging high-voltage 210 and a developing high-voltage 209 to perform image forming by controlling formation of electrostatic latent images, transfer of developed toner images, and so forth.

The CPU 206 receives detection results from the sensor L208 and sensor R212 of the detector 90, and performs calibration control. The sensor L208 and sensor R212 can detect a density control pattern serving as a test image (also called detection image). Density control performed when detecting the density control pattern by the detector 90 will be described. Density control is performed to adjust image density, so as to correct image density which changes under temperature and humidity conditions of the environment where the image forming apparatus is installed, and which change as use of the image forming stations of each color progresses. To perform density control, a density control pattern to serve as a test image is formed on the intermediate transfer belt 80, and values representing toner density are detected by the detector 90. Note that using density as the values related to toner density is only an exemplary representative index, and various other indies may be used instead, such as toner adhesion amount per unit area, toner chromaticity after fixing, area coverage by toner, reflectivity of the intermediate transfer belt 80 with toner present, and so forth.

Based on the detection results, the CPU 206 obtains correction data to perform correction of exposure data, charging voltage, developing voltage, and so forth, such that desired properties are realized in the formed images. Results detected by the sensor L208 and sensor R212 regarding the test image on the intermediate transfer belt 80 are transmitted to the CPU 206 as electrical signals, converted from analog values into digital values by the CPU 206, stored in the memory 205, and used to calculate correction values.

Description of the Sensors

Figure 3A:
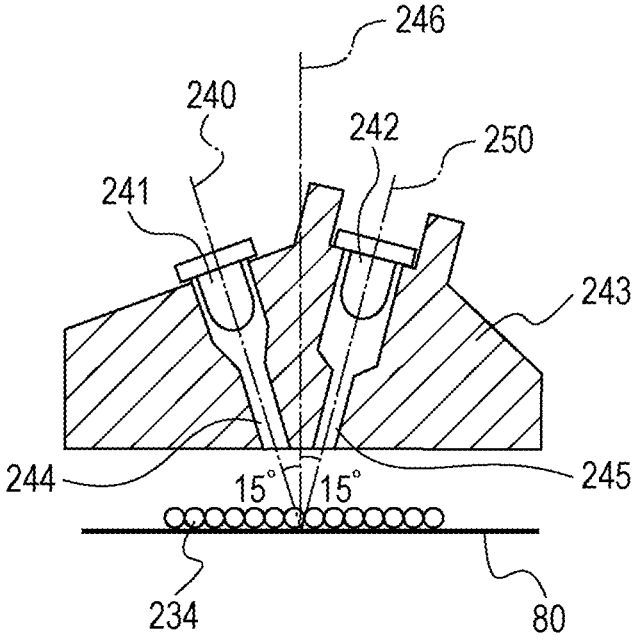
FIGS. 3A and 3B are cross-sectional views of left and right sensors.
Figure 3B:
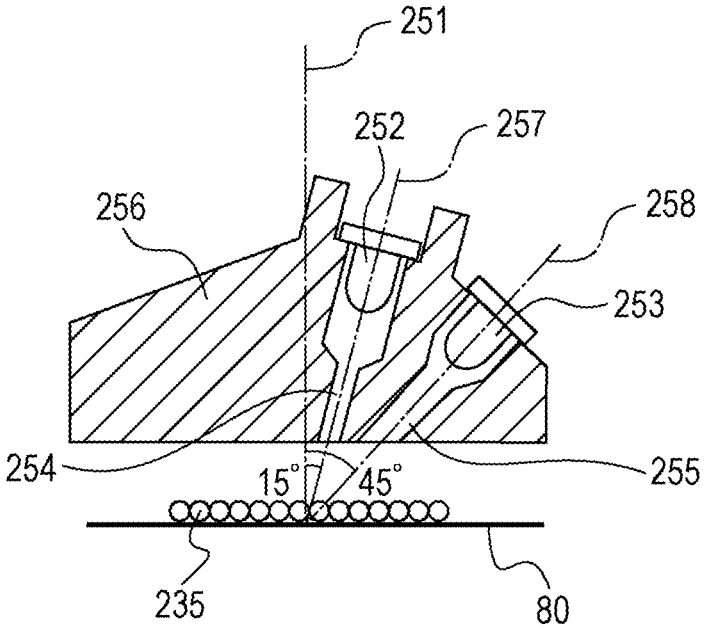

FIGS. 3A and 3B are cross-sectional views of the sensor L208 and sensor R212. FIG. 3A is a cross-sectional diagram of the sensor L208 according to the present embodiment, and FIG. 3B is a cross-sectional diagram of the sensor R212.

First, the sensor L208 will be described with reference to FIG. 3A. Inside the sensor L208, an LED 242 which is a light-emitting element and a phototransistor 241 which is a light-receiving element are attached to a sensor housing 243. The light emitted from the LED 242 passes through a light guide 245 at the light emitting side, and is cast on a test image 234 to be measured. The tip of the LED 242 has a spherical lens structure, so that the light emitted from a built-in chip is collected toward a center line 250 which is the optical axis, with stronger radial intensity. Normal reflection light reflected at the intermediate transfer belt 80 and diffused reflection light diffused when reflecting at the test image 234 pass through a light guide 244 at the receiving side, and are received at the phototransistor 241. The intensity of the received light is converted into electrical signals in accordance with the amount of light.

The center line 250 of the light guide 245 at the light emitting side and the center line 240 of the light guide 244 at the light receiving side are provided symmetrically across a normal line, at the same 15 degrees angle as to the vertical direction 246 to the intermediate transfer belt 80. This arrangement allows direct reflected light (normal reflected light) reflected off the intermediate transfer belt 80 to be taken into the light guide 244 with maximal efficiency.

Next, the sensor R212 will be described with reference to FIG. 3B. Inside the sensor R212, an LED 252 which is a light-emitting element and a phototransistor 253 which is a light-receiving element are attached to a sensor housing 256. The light emitted from the LED 252 passes through a light guide 254 at the light emitting side, and is cast on a test image 235 to be measured. The tip of the LED 252 has a spherical lens structure, so that the light emitted from a built-in chip is collected toward a center line 257 which is the optical axis, with stronger radial intensity. A part of the diffused reflection light which has scattered in various direction at the test image 235 pass through a light guide 255 at the receiving side, and received at the phototransistor 253. The intensity of the received light is converted into electrical signals in accordance with the amount of light.

The center line of the light guide 258 at the light receiving side is provided at an angle of 45 degrees as to the vertical direction 251 to the intermediate transfer belt 80. The light guide 258 at the receiving side is provided on the opposite side to which the direct reflected light is reflected. This arrangement maximally prevents direct reflected light from the light cast on the intermediate transfer belt 80 from the LED 252 from entering the light guide 255 at the light receiving side.

While an example has been described here where the sensor L208 receives normal reflection light and the sensor R212 receives diffused reflection light, the present embodiment is not restricted thusly. An arrangement may be made where the sensor L208 receives diffused reflection light and the sensor R212 receives normal reflection light. Alternatively, the sensor L208 and sensor R212 integrally form a density detection device. In the case, a control unit such as a CPU or the like may be installed within the density detection device. Also, the phototransistor 241 which is a light receiving element of the sensor L208 may be disposed at a direction where, of the reflected light that has been emitted from the LED 242 which is a light emitting element and reflected, the normal reflection light heads. On the other hand, the phototransistor 253 which is a light receiving element of the sensor R212 may be disposed at a direction different from the direction where, of the reflected light that has been emitted from the LED 252 which is a light emitting element and reflected, the normal reflection light heads.

Figure 4:
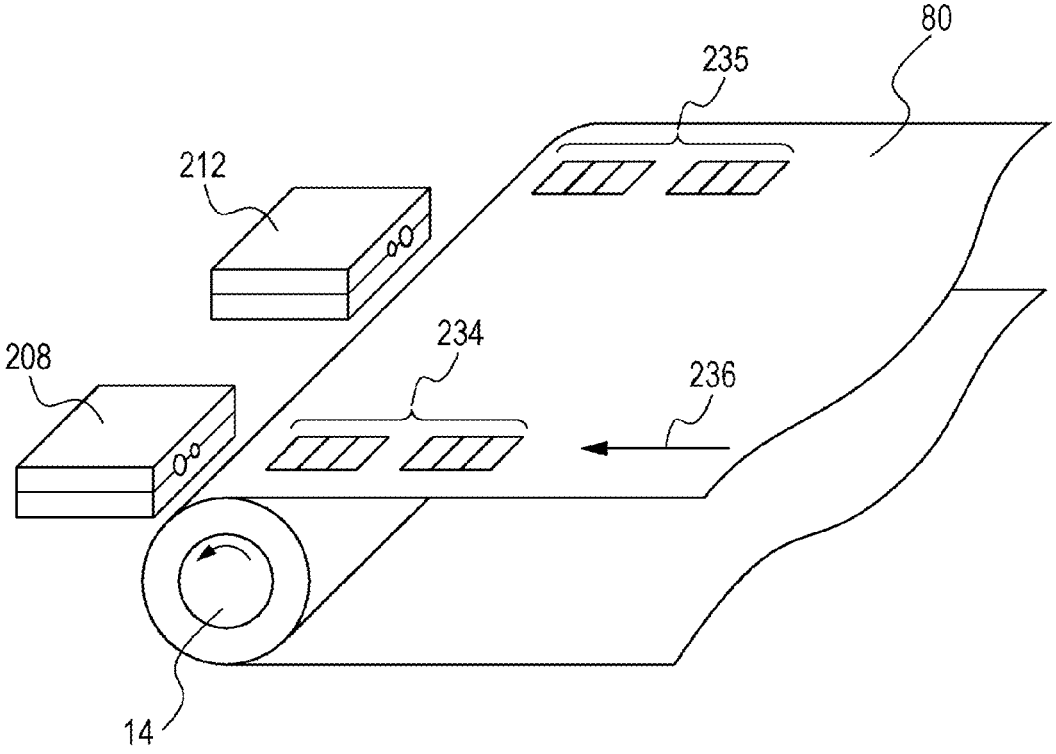
FIG. 4 is a perspective view illustrating test images formed on an intermediate transfer belt, and sensors.

FIG. 4 is a perspective view illustrating a test image formed on the intermediate transfer belt 80, and sensors. When performing density control, two rows of test images 234 and 235 are formed on the intermediate transfer belt 80. The test images 234 and 235 are formed so that they do not overlap in the direction orthogonal to the movement direction of the intermediate transfer belt 80. The test images 234 and 235 are sequentially detected by the sensor L208 and sensor R212 disposed on a line orthogonal to the movement direction of the intermediate transfer belt 80. The intermediate transfer belt 80 is driven by rotation of the secondary transfer opposing roller 15 so as to move in the direction of the arrow 236. The tension roller 14 which keeps the intermediate transfer belt 80 suitably tensioned rotates in the direction or the arrow due to the motion of the intermediate transfer belt 80.

The sensor L208 and sensor R212 are situated at a position facing the cylindrical curvature of the tension roller 14. The sensor L208 and sensor R212 are positioned at a certain distance as to tension roller bearings, so that the distance between the tension roller 14 and the sensor L208 and sensor R212 is generally fixed. The test images 234 and 235 which are the density control patterns formed on the intermediate transfer belt 80 are detected as they pass by the detection positions of the sensor L208 and sensor R212.

Light emitted from the sensor L208 and sensor R212 is cast upon the surface of the intermediate transfer belt 80 and on the test patterns 234 and 235, via the light guides on the emitting side. The reflected light reflected off the surface of the intermediate transfer belt 80 and the test images 234 and 235 is received by the sensor L208 and sensor R212 via the light guides on the receiving side. The intermediate transfer belt 80 moves in the direction of the arrow 236, whereby the test images are moved to the detection region of the sensor L208 and sensor R212. The intermediate transfer belt 80 preferably highly glossy to increase direct reflection light, and preferably is black to reduce scattered reflection. Any wavelength from ultraviolet to infrared may be used as the emission light of the LEDs, which are light-emitting elements, as long as a wavelength which is absorbed by black test images and exhibits scattered reflection on the color test images.

Description of Patches

Figure 5:
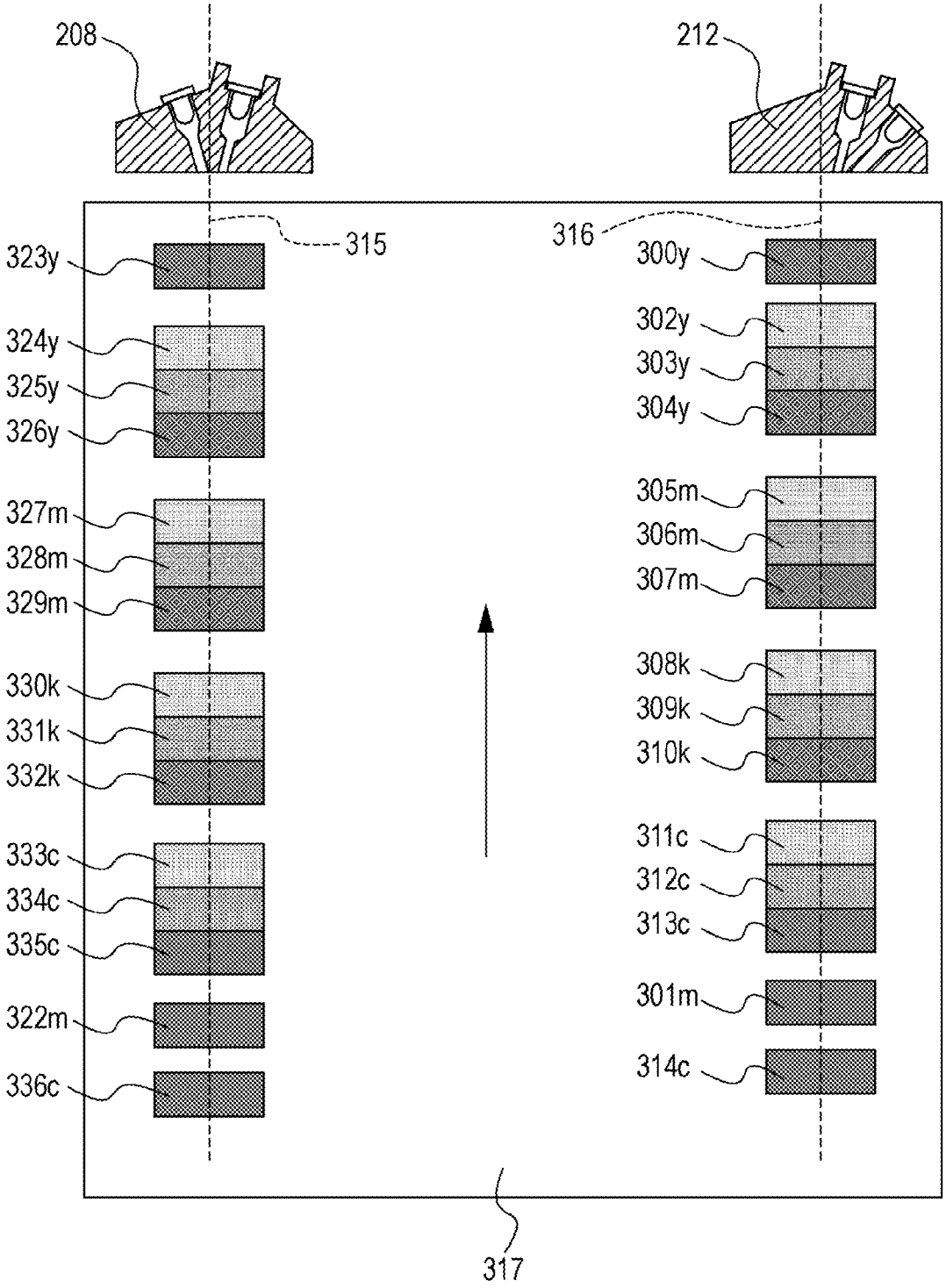
FIG. 5 is a diagram illustrating the test images formed on the intermediate transfer belt in detail.

FIG. 5 is a diagram illustrating details of test images 234 and 235 formed on the intermediate transfer belt 80. Note that the suffixes following reference numerals of the patches in FIG. 5 indicate the colors of the patches. The suffix y represents yellow, m represents magenta, c represents cyan, and k represents black, for the toner patches.

The test images 234 and 235 are formed on both edges of the intermediate transfer belt 80. The test image 234 made up of patches 323*y* through 336*c* are formed to include a detection region detected by the sensor L208 (position indicated by the dotted line in FIG. 5). The test image 235 made up of patches 300*y* through 314*c* are formed to include a detection region detected by the sensor L212 (position indicated by the dotted line in FIG. 5). The intermediate transfer belt 80 moves in the direction of the arrow in FIG. 5, whereby the patches 323*y* and 300*y* are detected by the sensors sensor L208 and sensor R212.

Next, each of the patches that have been formed will be described in detail. While yellow patches will be described for sake of convenience, the description is the same for patches of other colors as well. Note that the patches 302*y*, 303*y*, and 304*y* are patches to be measured regarding density. The patches are all yellow, but are of different toner amounts per unit area, so as to have a light tone, medium tone, and dark tone. In the same way, the patches 324*y*, 325*y*, and 326*y* are patches to be measured regarding density. The patches are all yellow, but are formed of different toner amounts per unit area, so as to have a light tone, medium tone, and dark tone.

Three types of patches with different toner amounts per unit area to be measured regarding density are formed in the same way for the other colors as well. The sensor L208 and sensor R212 detect these three types of patches, and obtain values regarding toner density. For example the patches 302*y* and 324*y* which are side by side in the horizontal direction are patches of the color yellow of the same coverage modulation. The multiple patches formed with the same coverage modulation are formed at positions in the direction orthogonal to the direction of movement of the intermediate transfer belt 80 where they are detected at generally the same timing. This is true regarding patches of other colors and patches of other tones. While three types of tones have been illustrated as an example of patches, multiple types of patches may be formed according to the detection accuracy that is desired. Patches 300*y* and 323*y* are so-called solid image patches with image data of 100% (coverage modulation of 100%). These patches 300*y* and 323*y* are patches used to correct difference in sensitivity between the sensor L208 and sensor R212.

The amount of toner per unit area of patches formed as a light tone of yellow, as with the patches 302*y* and 324*y* for example, is generally the same. The multiple patches with generally the same amount of toner per unit area are formed at positions in the direction orthogonal to the direction of movement of the intermediate transfer belt 80 where they so as to be detected at generally the same timing. This is true regarding patches of other colors and patches of other tones.

Principle Regarding Obtaining Values Related to Toner Density

Figure 6:
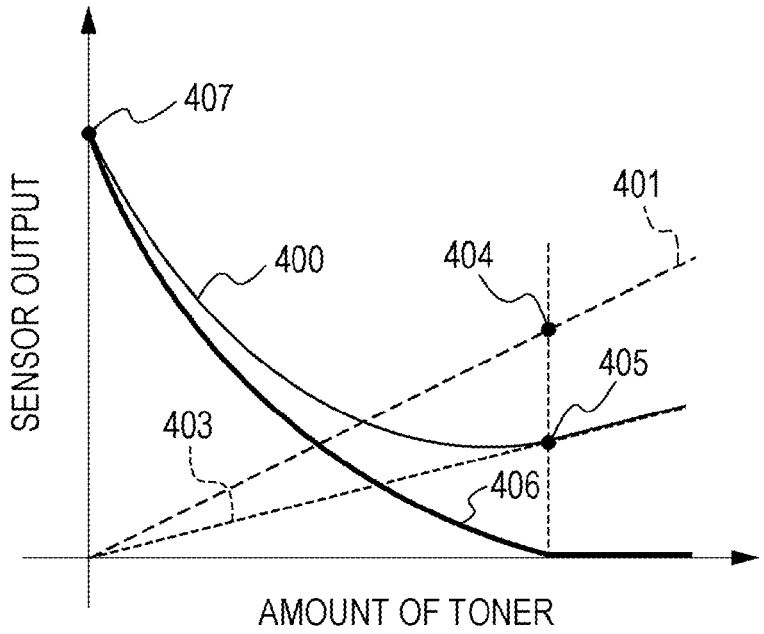
FIG. 6 is a diagram illustrating sensor output properties of the left and right sensors.

Next, a principle regarding obtaining values relating to toner density according to the present embodiment will be described. FIG. 6 is a diagram illustrating sensor output properties (voltage) of the sensor L208 and sensor R212.

A property line 400 indicates sensor output properties at the time of the sensor L208 (the configuration illustrated in FIG. 3A) performing detection on the surface of the intermediate transfer belt 80 where different toner amounts are adhered. That is to say, the sensor output reflects a state where there is no toner on the intermediate transfer belt 80, solid images, and images formed with toner amounts more than a solid image. In reality, the sensor output changes depending on the position of the intermediate transfer belt 80 as will be described later, and further the sensor output has an offset, but FIG. 6 illustrates conceptual output properties after having corrected for output fluctuation depending on the position on the intermediate transfer belt 80 and the offset.

In a case where there is no toner on the intermediate transfer belt 80 (407), the normal reflection light from the intermediate transfer belt 80 is greatest, so sensor output is also greatest. As the amount of toner increases, the normal reflection light from the intermediate transfer belt 80 decreases, so the sensor output also decreases. On the other hand, scattered reflection from the toner increases as the amount of toner increases, so the sensor output begins to increase after a certain toner amount.

A property line 401 illustrates sensor output properties at the time of the sensor R212 (the configuration illustrated in FIG. 3B) performing detection on the surface of the intermediate transfer belt 80 where different toner amounts are adhered. That is to say, the sensor output reflects a state from where there is no toner on the intermediate transfer belt 80, up to a state of solid images. The sensor R212 hardly detects any normal reflection light from the intermediate transfer belt 80, and primarily detects scattered reflection light from the toner, is the sensor output increases generally proportionately to the amount of toner.

Next, sensor output when detecting a solid image will be described. A solid image is an image with area printing ratio of 100%. The normal reflection light from the intermediate transfer belt 80 is generally zero, since the surface of the intermediate transfer belt 80 where the image has been formed is covered almost completely with one or two layers of toner. The amount of toner per unit area to be deemed generally zero normal reflection light is 0.35 mg/cm$^2$ or more. The output of the sensor L208 which has detected a solid image is denoted by 405, and the output of the sensor R212 is denoted by 404. In either case, there is almost no normal reflection light from the intermediate transfer belt 80, and what is being detected is scattered reflection light from the toner alone. Obtaining the ratios of the sensor outputs when detecting a solid image allows the difference in sensitivity between the sensor L208 and sensor R212, due to the LEDs being different and emitting amounts of light not the same, to be corrected.

A coefficient β to correct the difference in sensitivity is obtained by the following expression.

$$\beta = \text{sensor output when detecting solid image by sensor } L208 / \text{sensor output when detecting solid image by sensor } R212 \quad (1)$$

The property line 403 is obtained by multiplying the property line 401 which is the sensor output obtained by the sensor R212 by β. The property line 403 represents the sensor output for the scattered reflection light included in the sensor output of the sensor L208, and comes into contact with the property line at a point 405. Increasing the toner amount beyond that where the normal reflection light from the intermediate transfer belt 80 is generally zero (405) causes the scattered reflection light to increase linearly while the normal reflection light from the intermediate transfer belt 80 remains at zero. Accordingly, the sensor output represented by the property lines 401 and 403 linearly increase as the toner amount increases.

Figure 7:
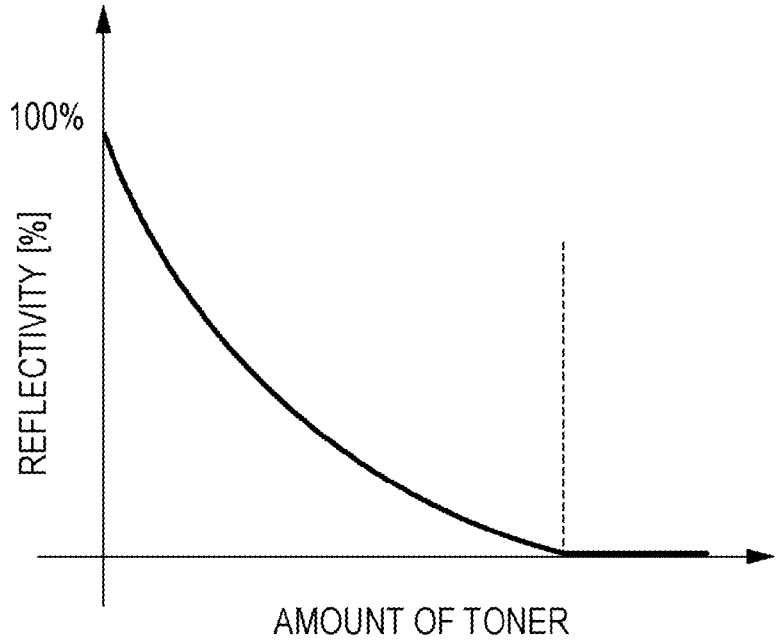
FIG. 7 is a diagram illustrating a properties line illustrating the relation between toner amount and reflectivity at the intermediate transfer belt.

A property line 406 is the difference between the property lines 400 and 403. The property line 406 represents the sensor output of the net normal reflection light reflected from the intermediate transfer belt 80 and detected by the sensor L208, indicating values related to toner density. Normalizing the property line 406 at the point when there is no toner on the intermediate transfer belt 80 (407), the property line illustrated in FIG. 7 is obtained, which represents the relation between the toner amount and the net normal reflection light from the intermediate transfer belt 80. The reflectivity of the net normal reflection light and the toner density correspond on a one-to-one basis, and can be converted into an optional value correlated with toner density, such as density, chromaticity, or the like (value related to toner density). Also, performing such normalization allows overall variation in sensitivity of the sensor L208, such as variation in light amount of the LED which is a light-emitting element, variation in irradiation spot, variation in sensitivity of the phototransistor which is the light receiving element, soiling of the sensor, and so forth, to be almost completely eliminated. Performing correction using the correction coefficient β and suppress deterioration in detection precision due to difference in the light source to detect the normal reflection light at the sensor L208 and the light source to detect diffused reflection light at the sensor R212 causing unbalanced weighting in the output values.

As one example of a specific Expression, a method for calculation values relating to toner density will be described. Output from the surface of the intermediate transfer belt 80 differs depending on the position on the intermediate transfer belt 80, so the output from the position serving as the background where the test image will be formed, is detected before forming the test image. The sensor output has an offset voltage, so the offset amount is measured in a state with the LED off, and this is subtracted from the sensor output with the LED turned on.

In the following Expression (2), Vsb represents the sensor output detected by the sensor L208 when detecting the background of the intermediate transfer belt 80. Vrb represents the sensor output detected by the sensor R212 when detecting the background of the intermediate transfer belt 80. Vst represents sensor output when detecting a test image (e.g., 324*y*) by the sensor L208 at the position 315, and Vrt represents sensor output when detecting a test image (e.g., 302*y*) by the sensor R212 at the position 316. Vst and Vrt are values when detecting patches of the same color and same tone. Vsk represents sensor output when detecting a solid image (e.g., 323*y*) by the sensor L208, and Vrk represents sensor output when detecting a solid image (e.g., 300*y*) by the sensor R212. Vsk and Vrk are values when detecting solid images of the same color. Vst, Vrt, Vsk, Vrk, Vsb, and Vrb are all values obtained by sampling voltage signals detected at the sensor L208 and sensor R212 and performing A/D conversion, and further subtracting the sensor voltage when the LED is off (offset voltage). 324*y* and 302*y* are of the same tone, and the reflectivity of net normal reflection light from the intermediate transfer belt 80 when detecting the patches of this tone can be obtained from the following Expression.

$$\text{reflectivity of net normal reflection light} = (Vst - Vsk/Vrk \cdot Vrt)/(Vsb - Vsk/Vrk \cdot Vrb) \quad (2)$$

That is, Expression (2) might be expressed as a calculated value obtained by correcting Vst and Vrt with correction coefficient Vsk/Vrk, being standardized by a value obtained by correcting Vsb and Vrb with correction coefficient Vsk/Vrk. The aforementioned values relating to the reflectivity of net normal reflection light and toner density (e.g., density, toner adhesion amount per unit area, toner chromaticity after fixing, area coverage by toner) are in a one-to-one relation. The values may be alternatively converted into values relating to toner density using a look-up table prepared beforehand.

Figure 8:
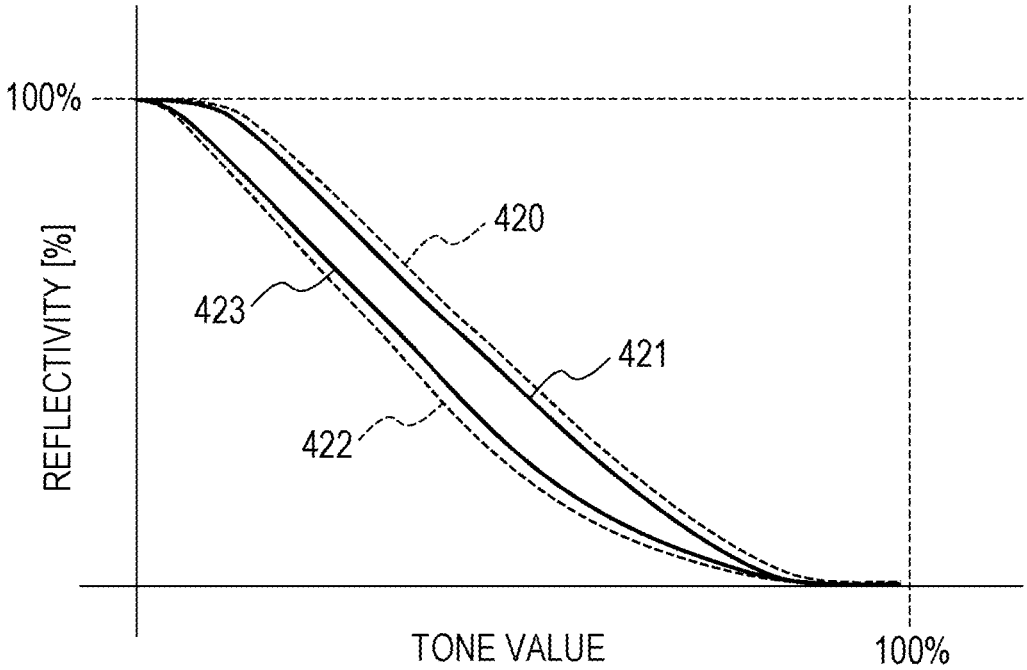
FIG. 8 is a diagram illustrating output of the left and right sensors, and the accuracy of averaging.

FIG. 8 is a diagram illustrating the output of the sensor L208 and sensor R212 according to the present embodiment, and the accuracy of averaging. Shown is a graph illustrating the results of obtaining the reflectivity of net normal reflection light in a case where the density of test images detected by the sensor L208 and sensor R212 differs, to confirm the accuracy of the detection result calculation method according to the present embodiment.

First, two cartridges storing toner (developer) of the same color but different developing properties were prepared. When forming same latent images to form test images of the same tone, the test image developed using one cartridge was darker than the test image developed using the other cartridge. The darker cartridge applies 10% more toner on the developing roller as compared to the lighter cartridge. In order to further create difference in density, the charging and developing electric potentials were adjusted so that the latent image electric potential (electric potential on the photosensitive drum) was stronger of the darker cartridge as compared to the lighter cartridge. Moreover, difference in density between the test images on the left and right sides of the intermediate transfer belt 80 was created, thereby replicating situations where the amount of toner applied to the developing roller is not the same in the longitudinal direction, and where the sensitivity of the photosensitive drum is not the same in the longitudinal direction due to difference in coating film thickness, resulting in different latent image electric potentials.

A test image to be detected by the sensor L208 was developed by the darker cartridge, and a test image to be detected by the sensor R212 was developed by the lighter cartridge. As described above, test patches are formed of multiple different tones, and the results of reflectivity of the net normal reflection light obtained from the detection results of the sensor L208 and sensor R212 yield the property line 423. The test image detected by the sensor L208 and the test image detected by the sensor R212 were both developed by the darker cartridge, and the results of obtaining reflectivity of the net normal reflection light yield property line 422. Also, the test image detected by the sensor L208 was developed by the lighter cartridge, the test image detected by the sensor R212 was developed by the darker cartridge, and the results of obtaining reflectivity of the net normal reflection light yield property line 421. Moreover, the test image detected by the sensor L208 and the test image detected by the sensor R212 were both developed by the lighter cartridge, and the results of obtaining reflectivity of the net normal reflection light yield property line 420.

It can be seen from these property lines that the property line 423 has higher reflectivity at the same tone than the property line 422, i.e., the amount of toner is smaller. Accordingly, a tendency can be observed in which the value relating to the toner density drops as the density of the test image detected by the sensor R212 becomes lighter. Also, it can be seen from these property lines that the property line 421 has lower reflectivity at the same tone than the property line 420, i.e., the amount of toner is greater. Accordingly, a tendency can be observed in which the value relating to the toner density rises as the density of the test image detected by the sensor R212 becomes darker. Property lines 421 and 423 are between property lines 420 and 422. Accordingly, even in cases where attempts to form test images of the same tone to the right and left result in variation between the test images to the left and right due to effects of change over time for example, effects of averaging the left and right variation can be obtained by this way of obtaining values relating to toner density according to the present embodiment.

Figure 9:
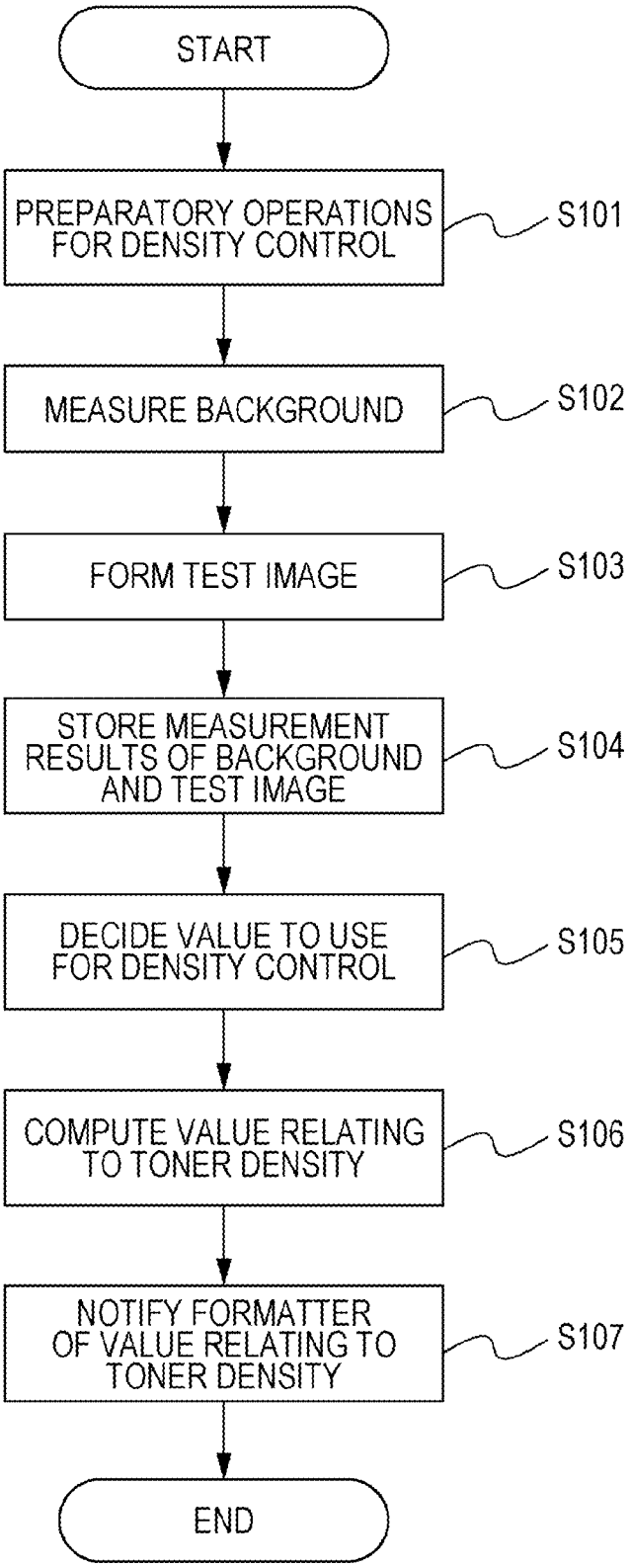
FIG. 9 is a flowchart for describing density control.

FIG. 9 is a flowchart for describing density control according to the present embodiment. In S101 the CPU 206 starts preparatory operations to perform density control. The actuators are started, and high-voltage control is performed, in the same way as when performing normal image forming operations. The sensor output in a state where the sensor L208 and sensor R212 are turned off (hereinafter, also referred to as "dark voltage") is detected. Next, the LEDs of the sensor L208 and sensor R212 are turned on to emit light of a predetermined quantity. The LEDs preferably emit light before starting detection by a sufficient amount of time, since it takes several seconds for the light output of the LEDs to stabilize.

In S102, the CPU 206 measures the signal level of the region on the intermediate transfer belt 80 where the test images are to be formed (background), before forming the test images. The signal level is measured by the sensor L208 and sensor R212 at predetermined intervals over generally one rotation of the intermediate transfer belt 80 in the direction of travel of the intermediate transfer belt 80. The electric signals detected by these sensors are periodically subjected to A/D conversion by the CPU 206, and stored in the memory 205 serving as a storage device as sampling values. Sampling values are digital data obtained by quantizing electric signals. Thus, reflection light is detected at a region where a test image is to be formed, i.e., in a state of no toner on the intermediate transfer belt 80.

In S103, the CPU 206 forms a test image on the intermediate transfer belt 80. In S104, the CPU 206 stores the sampling values which are detection results of detection by the sensor L208 and sensor R212. The detection is started at both the sensor L208 and sensor R212, and sampling values are stored beginning at a timing before the test images reach the detection region. The sampling values continue to be stored in the memory 205 until all test images have passed through the detection region.

In S105, the CPU 206 decides values to use for density control. The positions of the test images formed by each of the image forming stations on the intermediate transfer belt 80 is not the same, due to color shift caused by individual variety among the cartridges, individual variety of the image forming apparatus, running state of the image forming apparatus, and so forth. Accordingly, the positions of the test images are identified using solid images as a reference. Solid images have a relatively high are a coverage, and are readily detected with high accuracy, and great change in output indicates positional shift. Sampling values to use for density control are decoded from the sampling values stored as a result of having identified the test images. In the same way, background data to use for density control is selected from the background data stored in the same way.

In S106, the CPU 206 calculates reflectivity of net normal refection light at the intermediate transfer belt 80 at the time of having detected a test image. The calculation method is as described above. Values relating to toner density are calculated from the reflectivity of net normal refection light. An arrangement may be made where a look-up table is prepared indicating the relationship between the reflectivity of net normal refection light and the parameters regarding which measurement is desired, such as toner density, toner amount, color difference as to the paper, and so forth. In S107, the CPU 206 notifies the formatter 203 of the values regarding toner density. The formatter 203 creates a γ correction table, to obtain a target γ curve from correlation between each image data and values related to toner density. In the subsequent printing, image signals are subjected image data correction by the γ correction table, and then transmitted to the CPU 206. Thus, the γ curve for the image data and print data can be controlled to desired properties. The γ correction table may be created by the CPU 206. This ends the operations of density control Thus, density control can be performed using a sensor having one light-receiving element which receives normal reflection light, and a sensor having one light-receiving element which receives diffused reflection light, thereby suppressing increases in cost due to having included multiple sensors. The ratio of sensor output at the time of detecting solid images is obtained in this configuration where test patches are detected using multiple sensor having one light-receiving element. Accordingly, difference in sensitivity between the left and right sensors, such as difference in light quantity due to the sensor L208 and sensor R212 having different LEDs serving as the light-emitting elements, can be corrected. Accordingly, increases in cost can be suppressed while improving the accuracy of density correction control.

Second Embodiment

The first embodiment has been described regarding an example of sensors where light is emitted from dome-type LEDs. In the second embodiment, a system will be described where density control is performed using sensors where light is emitted from chip-type LEDs. Detailed description of components which are the same as with the first embodiment will be omitted here.

Description of Sensors

Figure 10A:
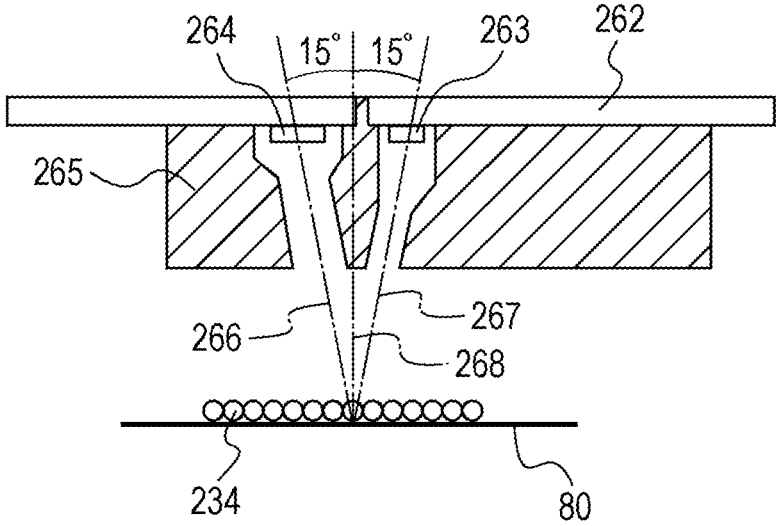
FIGS. 10A and 10B are cross-sectional views of the left and right sensors.
Figure 10B:
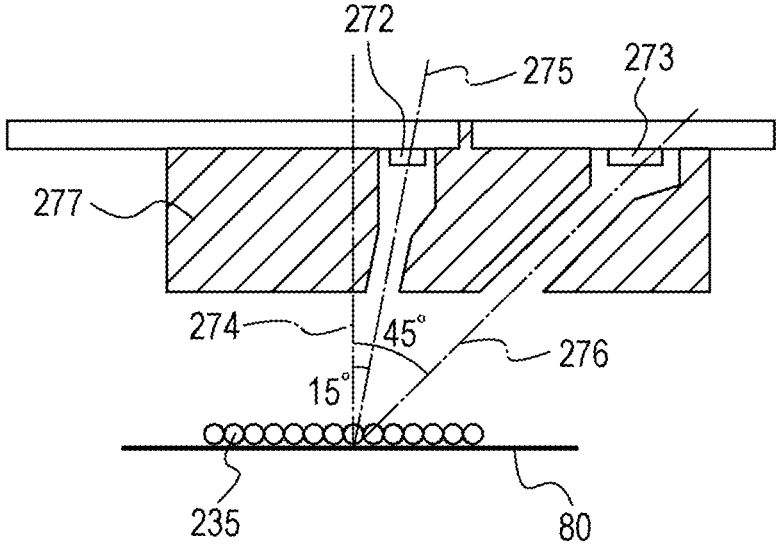

FIGS. 10A and 10B are cross-sectional views of the sensor L208 and sensor R212. FIG. 10A is a cross-sectional view of the sensor L208, and FIG. 10B is a cross-sectional view of the sensor R212.

First, the sensor L208 will be described with reference to FIG. 10A. The sensor L208 detects normal reflection light from the intermediate transfer belt 80 and test images 234. A chip LED 263 and chip light-receiving element 264 are mounted on a circuit board 262, and soldered. Housing 265 forms the light guides for the chip LED 263 and chip light-receiving element 264. The center line 267 and 266 of the light guides are provided symmetrically as to the vertical direction 268 to the intermediate transfer belt 80, at 15 degrees. This arrangement allows direct reflected light (normal reflected light) reflected off the intermediate transfer belt 80 and test image 234 to be taken into the light guide on the receiving side with maximal efficiency, in the same way as with the first embodiment.

Next, the sensor R212 will be described with reference to FIG. 10B. The sensor R212 detects diffused reflection light from the test images 235. A chip LED 272 and chip light-receiving element 273 are mounted on a circuit board, and soldered. Housing 277 forms the light guides for the chip LED 272 and chip light-receiving element 273. The center line 275 of the light guide on the light emitting side is provided at an angle of 15 degrees as to the vertical direction 274 to the intermediate transfer belt 80. The center line 276 of the light guide at the light receiving side is provided at an angle of 45 degrees as to the vertical direction 274 to the intermediate transfer belt 80. This arrangement maximally prevents direct reflected light from the intermediate transfer belt 80 from entering the light guide at the light receiving side, in the same way as with the first embodiment.

While an example has been described here where the sensor L208 receives normal reflection light and the sensor R212 receives diffused reflection light, the present embodiment is not restricted thusly. An arrangement may be made where the sensor L208 receives diffused reflection light and the sensor R212 receives normal reflection light. Alternatively, the chip light-receiving element 264 of the sensor L208 may be disposed at a direction where, of the reflected light that has been emitted from the chip LED 263 and reflected, the normal reflection light heads. On the other hand, the chip light-receiving element 273 of the sensor R212 may be disposed at a direction different from the direction where, of the reflected light that has been emitted from the chip LED 272 and reflected, the normal reflection light heads.

The configuration illustrated in FIGS. 10A and 10B use a resin-mold type optical element for the LED, which is a light-emitting element, and the light-receiving element (phototransistor or photodiode). A lead frame is provided which enables the direction of the light-emitting element and light-receiving element to be changed with a certain degree of freedom by changing the angle of bending the lead frame, so there is a high level of freedom regarding the placement angle and placement position. Accordingly, the direction with excellent optical properties (the direction in which the intensity of light emission is great for LEDs, the direction in which photosensitivity is high for light-emitting elements, for example) can be directed toward the object of measurement. Thus, the capabilities of the light-emitting element and light-receiving element, which are the intensity of light irradiated on the measurement object and sensitivity of received reflected light, can be used to the fullest extent. However, the presence of the lead frame require a certain level of volume from the light-emitting element and light-receiving element to the circuit board, which results in the overall sensor being somewhat larger.

Figure 11A:
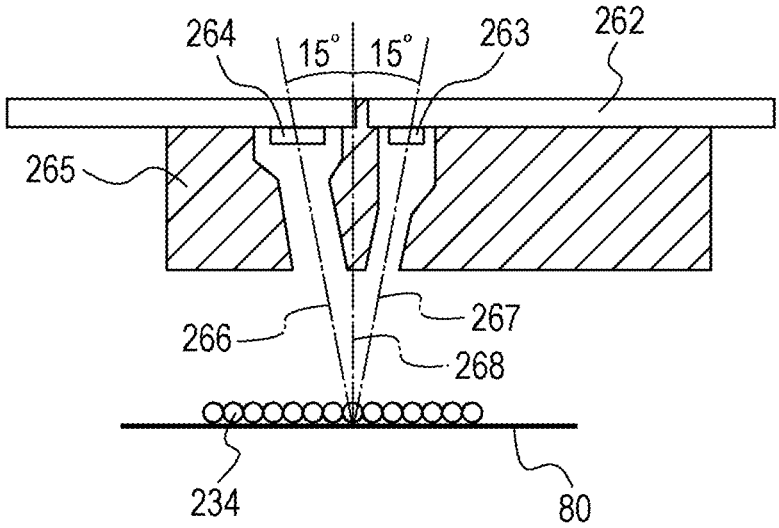
FIGS. 11A and 11B are cross-sectional views of the left and right sensors.
Figure 11B:
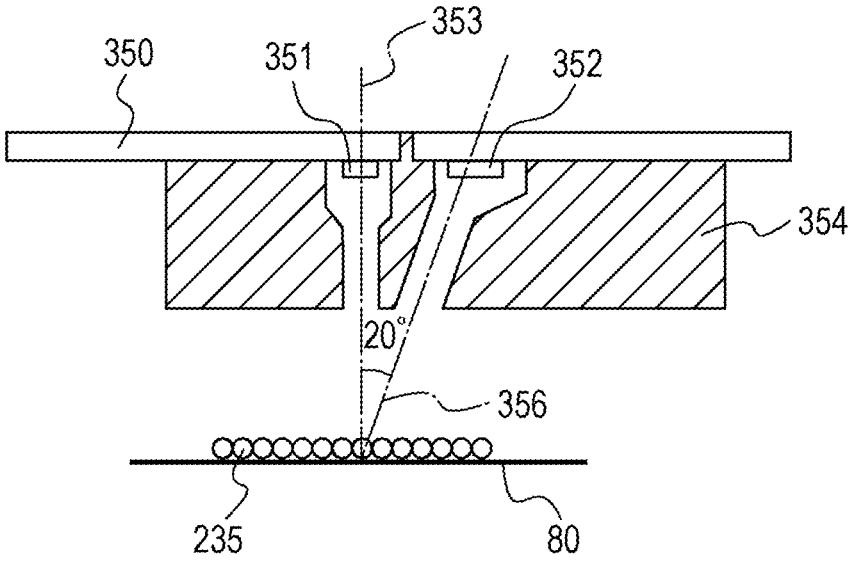

When consideration reduction in the size of the sensors, sensors such as illustrated in FIGS. 11A and 11B may be used. The sensors illustrated in FIGS. 11A and 11B use surface-mounted optical elements where chips are mounted directly on the circuit board, and the size can be reduced as compared to those illustrated in FIGS. 10A and 10B, since there is no lead frame. The direction with excellent optical properties in the case of surface-mounted optical elements is the direction vertical to the mounted face of the optical element. Accordingly, the greater the angle of the optical path is as to the vertical direction of the face where the optical element is mounted, the smaller the light emission intensity of the LED is, and the lower the photo sensitivity of the light-receiving element is. FIGS. 11A and 11B illustrate the optical element of the sensor placed taking this point into consideration.

First, the sensor L208 will be described with reference to FIG. 11A. The sensor L208 is a sensor which detects normal reflection light form the intermediate transfer belt 80 or test image 234, and the configuration is the same as that in FIG. 10A described earlier, so detailed description thereof will be omitted.

Next, the sensor R212 will be described with reference to FIG. 11B. The sensor R212 detects diffused reflection light from the test image 235. Employing the surface-mounted type optical element means that the light guide of the optical element is preferably as close to the vertical direction as possible, to improve light emission intensity or photosensitivity. FIG. 11B illustrates the center line of the optical path of the LED 351 serving as the light-emitting element is the same direction as the vertical direction 353 as to the intermediate transfer belt 80. The center line of the optical path of the light-receiving element 352 is provided at a 20 degree angle to the vertical direction 353 as to the intermediate transfer belt 80. This configuration enables the light emission intensity of the light-emitting element to be improved. However, the light guide of the light receiving side is close to the reflection region of normal reflection light from the intermediate transfer belt 80, so there is a possibility that a part of the normal reflection light from the intermediate transfer belt 80 might be input to the light receiving side. Accordingly, an arrangement may be made where the center line of the optical path of the LED 351 is at a 20 degree angle as to the vertical direction 353 of the intermediate transfer belt 80, and the center line of the optical path of the light-receiving element 352 is provided in the same direction as the vertical direction 353 as to the intermediate transfer belt 80.

Principle of Obtaining Values Relating to Toner Density

Figure 12:
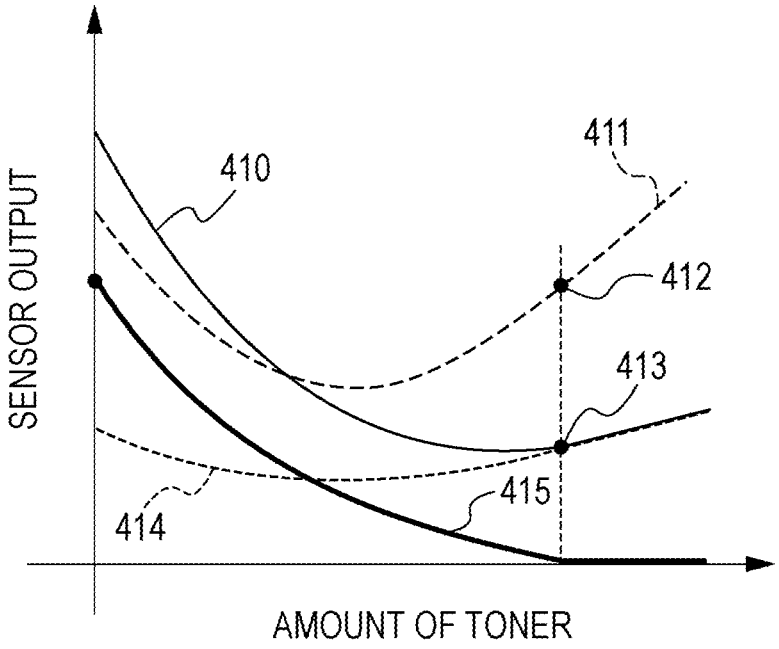
FIG. 12 is a diagram illustrating sensor output properties of the left and right sensors.

Next, the principle of obtaining values relating to toner density according to the present embodiment will be described. FIG. 12 is a diagram illustrating sensor output properties of the sensor L208 and sensor R212.

A property line 410 illustrates sensor output properties in a case of the sensor L208 (the configuration illustrated in FIG. 11A) detecting upon the intermediate transfer belt 80 where different toner amounts are adhered. The term "different toner amounts" means that there are states where there is no toner on the intermediate transfer belt 80, to states where solid images are formed, and there are respective sensor outputs. The normal reflection light from the intermediate transfer belt 80 decreases as the toner amount increases, as described with reference to FIG. 6 in the first embodiment, so sensor output drops. On the other hand, diffused reflection light from the toner gradually increases as the toner amount increases, so the sensor output begins to increase at a certain amount of toner.

A property line 411 illustrates sensor output properties at the time of the sensor R212 (the configuration illustrated in FIG. 11B) performing detection on the surface of the intermediate transfer belt 80 where different toner amounts are adhered. That is to say, the sensor output reflects a state from where there is no toner on the intermediate transfer belt 80, up to a state of solid images. The sensor R212 in FIG. 11B detects some normal reflection light from the intermediate transfer belt 80 even when the toner amount is zero, so the output is not zero. Even in cases of such sensor output, obtaining the ratios of the sensor outputs when detecting a solid image the same way as with the first embodiment allows the difference in sensitivity between the sensor L208 and sensor R212, due to the LEDs being different and emitting amounts of light not the same, to be corrected. The correction coefficient β to correct the difference in sensitivity can be obtained in the same way as with the first embodiment.

When detecting a solid image, both the sensor L208 and sensor R212 are detecting only diffused reflection, so the property line 414 obtained by multiplying the property line 411 by the correction coefficient β is found to have the same diffused light component as that included in the property line 410, but the normal reflection component differs. Accordingly, the difference between the property line 410 and the property line 414 yields a property line 415, so the normal reflection component can be extracted alone. Standardizing the output when the toner amount is zero on the property line 415 yields a property line representing the relation between the toner amount and the reflectivity of the intermediate transfer belt 80, in the same way as in FIG. 7 described earlier in the first embodiment. Detailed calculation method is the same as in the first embodiment.

The ratio between the sensor output for normal reflection detected in a state where toner is zero, and sensor output for normal reflection when a solid image is formed (normal reflection from the intermediate transfer belt 80 becomes approximately zero) is a normal/diffused ratio. This is a value representing the ratio between the amount of normal reflection light input and the amount of diffused reflection light input, which is a combined property of the intermediate transfer belt 80 and the sensors. The normal/diffused ratio of the sensor illustrated in FIG. 10B is zero. On the other hand, the normal/diffused ratio of the sensor illustrated in FIG. 11A is 4, and the normal/diffused ratio of the sensor illustrated in 11B is 1. Thus, in a case of using sensors with different normal/diffused ratios, performing sensor output correction using the correction coefficient β to correct the difference in sensitivity allows accurate density control to be performed.

The greater the normal/diffused ratio between the sensor L208 and the sensor R212 is, the greater the sensor output at the time of extracting the normal reflection light is, so determination accuracy can be improved. As one example of the present embodiment, putting the normal/diffused ratio of the sensor L208 which detects normal reflection as x and the normal/diffused ratio of the sensor R212 which detects diffused reflection as y, y/x is preferably 0.8 or lower to obtain good determination accuracy, and more preferably 0.5 or lower. These conditions enables the dynamic range to be broadened, and determination accuracy to be improved.

Note that the normal/diffused ratio of the sensor L208 and sensor R212 can be increased by changing the optical paths of the sensor L208 and sensor R212. Specifically, the amount of detection of normal reflection can be adjusted by changing one or the other of the angle of the optical axis of the LED serving as the light-emitting element, and the angle of the optical axis of the transistor serving as the light-receiving element. At this time, the sensor L208 which detects normal reflection has the angles of the optical axis on the LED side and the optical axis on the light receiving side to be symmetrical as to the vertical direction as to the intermediate transfer belt 80, so as to maximally input normal reflection. On the other hand, the sensor R212 which detects diffused reflection preferably has the angles of the optical axis on the LED side and the optical axis on the light receiving side to not be symmetrical as to the vertical direction as to the intermediate transfer belt 80, so as to minimize input of normal reflection. The normal/diffused ratio also be changed among the sensors can by changing the cross-sectional area of the light guide holes formed in the housing for the sensor L208 and sensor R212.

Thus, density control can be performed using a sensor having one light-receiving element which receives normal reflection light, and a sensor having one light-receiving element which receives diffused reflection light, thereby suppressing increases in cost due to having included multiple sensors. The ratio of sensor output at the time of detecting solid images is obtained in this configuration where test patches are detected using multiple sensor having one light-receiving element. Accordingly, difference in sensitivity between the left and right sensors, such as difference in light quantity due to the sensor L208 and sensor R212 having different LEDs serving as the light-emitting elements, can be corrected. Accordingly, increases in cost can be suppressed while improving the accuracy of density correction control.

Third Embodiment

The first and second embodiments have been described regarding an example of sensors where light is emitted from dome-type LEDs or chip type LEDs. In the third embodiment, a system will be described where density control is performed using sensors using a beam splitter as a polarization device. Detailed description of components which are the same as with the first and second embodiments will be omitted here.

Description of Sensors

Figure 13A:
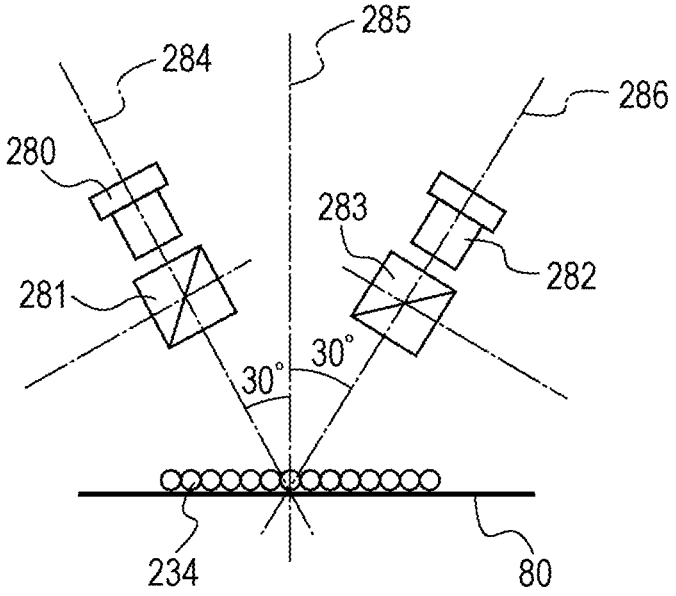
FIGS. 13A and 13B are cross-sectional views of the left and right sensors.
Figure 13B:
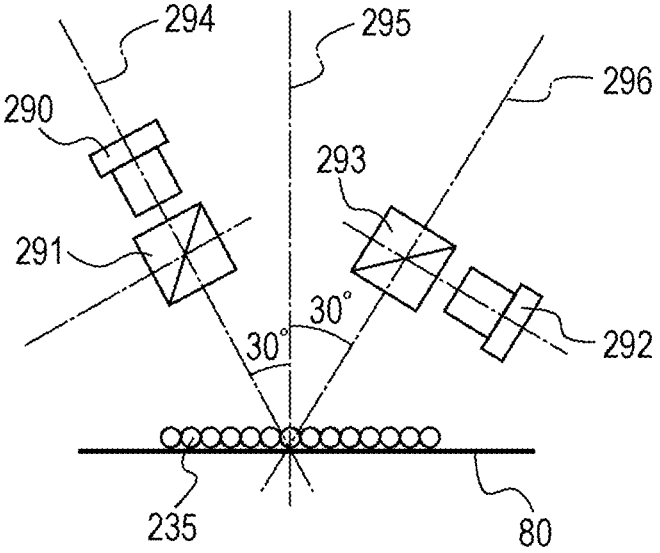

FIGS. 13A and 13B are cross-sectional views of the sensor L208 and sensor R212. FIG. 13A is a cross-sectional view of the sensor L208, and FIG. 13B is a cross-sectional view of the sensor R212.

First, the sensor L208 will be described with reference to FIG. 13A. The sensor L208 detects normal reflection light from the intermediate transfer belt 80 or the test image 234. Light emitted from a LED 280 serving as a light-emitting element passes through a beam splitter 281 and is irradiated upon the intermediate transfer belt 80 or test image 234. The light including p polarized light and s polarized light emitted from the LED 280 has the s polarized light component cut out at the beam splitter 281, so only the p polarized light component is irradiated on the intermediate transfer belt 80 or test image 234.

The light irradiated on the test image 234 is partly reflected at the surface of the toner, and partly absorbed. Part of the light transmits through the toner layer, part thereof is reflected off the intermediate transfer belt 80, and part is absorbed. The light reflected at the surface of the test image 234 has the polarization thereof disturbed, and includes both p polarized light and s polarized light. Also, the light reflected off the intermediate transfer belt 80 exhibits no disturbance and remains p polarized light. Normal reflection light off the intermediate transfer belt 80 and test image 234 thus has the s polarized light component removed by a beam splitter 283, and only the p polarized light component is received by a photodiode 282 serving as a light receiving element, as p-wave light (normal reflection light).

The center line 284 of the optical path of the LED 280 and the center line 286 of the optical path of the photodiode 282 are provided symmetrically as to the vertical direction 285 to the intermediate transfer belt 80, at 30 degrees. This arrangement allows direct reflected light (normal reflected light) reflected off the intermediate transfer belt 80 and test image 234 to be input with maximal efficiency, in the same way as with the first and second embodiments.

Next, the sensor R212 will be described with reference to FIG. 13B. The sensor R212 detects diffused reflection light from the test image 235. Light emitted from a LED 290 serving as a light-emitting element passes through a beam splitter 291 and is irradiated upon the test image 235. The light including p polarized light and s polarized light emitted from the LED 290 has the s polarized light component cut out at the beam splitter 281, so only the p polarized light component is irradiated on the test image 235.

The light irradiated on the test image 235 is partly reflected at the surface of the toner, and partly absorbed. The light reflected at the surface of the test image 235 has the polarization thereof disturbed, and includes both p polarized light and s polarized light. Diffused reflection light off the test image 235 thus has the p polarized light component removed by a beam splitter 293, and only the s polarized light component is received by a photodiode 282 serving as a light receiving element, as s-wave light (diffused reflection light).

The center line 294 of the optical path of the LED 290 and the center line 296 of the optical path of the beam splitter 293 are provided symmetrically as to the vertical direction 295 to the intermediate transfer belt 80, at 30 degrees. This arrangement allows light reflected off the test image 235 to be input with maximal efficiency, and the s-wave light extracted by the beam splitter 293 to be received by the photodiode 292.

The method to perform density control using the sensor output detected by the sensor L208 and sensor R212 is the same as that described in the first and second embodiments, so detailed description will be omitted here.

Thus, density control can be performed using a sensor having one light-receiving element which receives normal reflection light, and a sensor having one light-receiving element which receives diffused reflection light, thereby suppressing increases in cost due to having included multiple sensors. The ratio of sensor output at the time of detecting solid images is obtained in this configuration where test patches are detected using multiple sensor having one light-receiving element. Accordingly, difference in sensitivity between the left and right sensors, such as difference in light quantity due to the sensor L208 and sensor R212 having different LEDs serving as the light-emitting elements, can be corrected. Accordingly, increases in cost can be suppressed while improving the accuracy of density correction control.

Application Example

While embodiments have been described where normal reflection is detected by the sensor L208 and diffused reflection is detected by the sensor R212, the present invention is not restricted to this, and a configuration may be made where diffused reflection is detected by the sensor L208 and normal reflection is detected by the sensor R212. In this case, the normal reflection component and diffused reflection component which are the parameters described regarding Expressions (1) and (2) should be interchanged for performing the calculation. While description has been made regarding an example of using two sensors, to facilitate description, the same control can be performed three or more sensors.

Also, the sensor L208 and sensor R212 are not necessarily restricted to being the same type of sensor. These may be combined optionally, such as the configuration illustrated in FIG. 3A being used for the sensor L208 and the configuration illustrated in FIG. 10B being used for the sensor R212, for example, as long as difference in the normal/diffused ratio between the sensor L208 and sensor R212 is great enough to obtain sufficient determination accuracy. Sensors of the configuration illustrated in FIGS. 3A, 10A, 11A, and 13A which have been described in the embodiments are sensors to detect regular reflection from the intermediate transfer belt 80. Sensors of the configuration illustrated in FIGS. 3B, 10B, 11B, and 13B which have been described in the embodiments are sensors to detect diffused reflection from the test images 235. Any combination may be used as long as a combination between a sensor of a type to detect normal reflection and a sensor of a type to detect diffused reflection.

Also, description has been made regarding the above-described embodiments that sensor output values for solid images are used to correct the difference in sensitivity between the sensor L208 and sensor R212 such as difference in quantity of light of the LEDs. However, a configuration where related parameters are stored in memory serving as a storage device, so that the correction coefficient β can be obtained beforehand, allows difference in sensitivity to be corrected without forming solid images for calibration. Doing away with the need to form solid images to correct the sensitivity difference allows downtime related to density correction to be suppressed.

Specifically, detection results of having the sensor L208 and sensor R212 detect solid images, or a reference object such as a reference plate or the like where the normal reflection light is almost zero, so as to have the same effects as solid images, are stored in memory. Alternatively, parameters to obtain the correction coefficient β, such as the proportions of detection results, light quantity settings when performing detection, amplification settings of the electric circuit, and so forth, are stored in memory, so as to obtain the correction coefficient β or Vsk/Vrk. The obtained correction coefficient β may be stored in the memory instead. The reference object preferably has greater surface roughness of size greater than the wavelength of the light emitted from the LED, and the surface preferably is not smooth. This sort of configuration allows output with small normal reflection and great diffused reflection. Alternatively, a configuration may be made where a mechanism to adjust the sensitivity of at least one sensor is provided, so that the correction coefficient β or Vsk/Vrk is adjusted to a certain constant number at the time of manufacturing, so that the certain constant number can be used for the correction coefficient β or Vsk/Vrk in the calculations when performing density control.

Description has been made exemplarily in the embodiments regarding properties in a case of using toner of which the color material reflects wavelengths of light irradiated thereupon. On the other hand, this may be toner of which the color material absorbs wavelengths of light irradiated thereupon (e.g., black toner, or toner of a complementary color to the color of the irradiate light). In this case, the form of the property lines will be different, but the values relating to toner density can be obtained in the same way as with that described embodiments. In this case, when calculating the correction coefficient β, the amount of scattered reflection light used for sensor output when detecting a block toner solid image is small, and the output value also is small. This may lead to error in correction of sensor sensitivity difference. This can be dealt with by storing a correction coefficient β of detecting a solid image of toner of another color even when obtaining the correction coefficient β for black toner, and using this as the correction coefficient β for black toner, thus suppressing error in correction of sensor sensitivity different.

Also, while an example of forming test images on the intermediate transfer belt 80 which is a rotary member has been described in the embodiments, the present invention is not restricted to this. Examples of rotary members on which test images may be formed include the photosensitive drum, electrostatic conveying belt to convey recording material, or any other member upon which a test image can be formed and the formed test image detected.

According to configurations of the present invention, increase in costs can be suppressed while improving the precision of density correction control.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-133532 filed Jun. 26, 2013, which is hereby incorporated by reference herein in its entirety.

What is claimed is:

1. An image forming apparatus, comprising:

an image bearing member;

an image forming unit configured to form a first detection image and a second detection image, which are toner images, on the image bearing member;

a first detecting unit having a singular first light-receiving element, which is only one light-receiving element of the first detecting unit, and is configured to receive normal reflection light obtained from light having been emitted from a first light-emitting element toward the first detection image formed on the image bearing member and specularly reflected from the image bearing member;

a second detecting unit having a singular second light-receiving element, which is only one light-receiving element of the second detecting unit, and is configured to receive diffused reflection light obtained from light having been emitted from a second light-emitting element toward the second detection image formed on the image bearing member and diffuse-reflected from the second detection image; and a control unit configured to obtain a value relating to toner density based on a first detection result detected by the first detecting unit and a second detection result detected by the second detecting unit.

2. The image forming apparatus according to claim 1, wherein the control unit obtains the value relating to the toner density, based on a correction result of having corrected the first detection result and the second detection result by a correction coefficient.

3. The image forming apparatus according to claim 2, wherein the control unit obtains the correction coefficient based on a detection result of having detected a solid image by the first detecting unit and the second detecting unit, or a detection result of having detected a reference object where normal reflection light is substantially zero.

4. The image forming apparatus according to claim 2, further comprising:

a storage unit configured to store the correction coefficient;

wherein the control unit corrects the second detection result by the correction coefficient stored in the storage unit.

5. The image forming apparatus according to claim 2, wherein information relating to the toner density is obtained, based on a first calculation result obtained by subtracting, from the first detection result, a correction result where the second detection result has been corrected by the correction coefficient.

6. The image forming apparatus according to claim 5, wherein the control unit obtains values relating to the toner density, based on a result of subtracting, from a third detection result of detecting normal reflection light reflecting from a position on the image bearing member where no detection image is formed by the first detecting unit, a fourth detection result of detecting diffused reflection light reflecting from a position on the image bearing member where no detection image is formed by the second detecting unit, the fourth detection result having been corrected by the correction coefficient to obtain a correction result, thereby obtaining a second calculation result, and normalizing the first calculation result by the second calculating result.

7. The image forming apparatus according to claim 1, wherein the first detection image and the second detection image are of chromatic color or achromatic color.

8. The image forming apparatus according to claim 1, wherein the first detection image and the second detection image are of the same color.

9. The image forming apparatus according to claim 1, wherein the first detection image and the second detection image are formed so that the amounts of toner per unit area are substantially the same.

10. The image forming apparatus according to claim 9, wherein the first detection image and the second detection image of which the amounts of toner per unit area are substantially the same, are of the same color.

11. The image forming apparatus according to claim 1, wherein the control unit controls image forming conditions at the time of forming an image by the image forming unit, based on a value relating to the toner density.

12. An image forming apparatus, comprising:

an image bearing member;

an image forming unit configured to form a first detection image and a second detection image, which are toner images, on the image bearing member;

a first detecting unit having a singular first light-receiving element, which is only one light-receiving element of the first detecting unit, and is configured to receive normal reflection light obtained from light having been emitted from a first light-emitting element toward the first detection image formed on the image bearing member and specularly reflected from the image bearing member;

a second detecting unit having a singular second light-receiving element, which is only one light-receiving element of the second detecting unit, and is configured to receive diffused reflection light obtained from light having been emitted from a second light-emitting element toward the second detection image formed on the image bearing member and diffuse-reflected from the second detection image; and a control unit configured to control image forming conditions at the time of forming an image by the image forming unit, based on a first detection result detected by the first detecting unit and a second detection result detected by the second detecting unit.

13. A density detecting device comprising:

a first detecting unit having a singular first light-receiving element, which is only one light-receiving element of the first detecting unit, and is configured to receive normal reflection light obtained from light having been emitted from a first light-emitting element toward a first detection image formed on an image bearing member and specularly reflected from the image bearing member;

a second detecting unit having a singular second light-receiving element, which is only one light-receiving element of the second detecting unit, and is configured to receive diffused reflection light obtained from light having been emitted from a second light-emitting element toward the second detection image formed on the image bearing member and diffuse-reflected from the second detection image; and a control unit configured to obtain a value relating to toner density based on a first detection result detected by the first detecting unit and a second detection result detected by the second detecting unit.

14. An image forming apparatus, comprising:

a rotary member;

an image forming unit configured to form a plurality of detection images, which are toner images, on the rotary member;

a first detecting unit having a first light-receiving element disposed to face a direction of normal reflection of light, the light having been emitted from a first light-emitting element toward a first detection image formed on the rotary member and reflected thereat;

a second detecting unit having a second light-receiving element disposed to face a direction different from a direction of normal reflection of light, the light having been emitted from a second light-emitting element toward a second detection image formed on the rotary member and reflected thereat; and a control unit configured to control image forming conditions at the time of forming an image by the image forming unit, based on a correction result of having corrected a first detection result detected by the first detecting unit, and a second detection result detected by the second detecting unit, by a correction coefficient.

15. An image forming apparatus, comprising:

a rotary member;

an image forming unit configured to form a plurality of detection images, which are toner images, on the rotary member;

a first detecting unit having a first light-receiving element disposed to face a direction of normal reflection of light, the light having been emitted from a first light-emitting element toward a first detection image formed on the rotary member and reflected thereat;

a second detecting unit having a second light-receiving element disposed to face a direction different from a direction of normal reflection of light, the light having been emitted from a second light-emitting element toward a second detection image formed on the rotary member and reflected thereat; and a control unit configured to obtain a value relating to toner density based on a correction result of having corrected a first detection result detected by the first detecting unit, and a second detection result detected by the second detecting unit, by a correction coefficient.

16. The image forming apparatus according to claim 15, wherein the control unit obtains the correction coefficient based on a detection result of having detected a solid image by the first detecting unit and the second detecting unit, or a detection result of having detected a reference object where normal reflection light is substantially zero.

17. The image forming apparatus according to claim 15, wherein the first detection image and the second detection image are of chromatic color or achromatic color.

18. The image forming apparatus according to claim 15, wherein the first detection image and the second detection image are of the same color.

19. The image forming apparatus according to claim 15, wherein the first detection image and the second detection image are formed so that the amounts of toner per unit area are substantially the same.

20. The image forming apparatus according to claim 19, wherein the first detection image and the second detection image of which the amounts of toner per unit area are substantially the same, are of the same color.

21. The image forming apparatus according to claim 15, wherein information relating to the toner density is obtained, based on a first calculation result obtained by subtracting, from the first detection result, a correction result where the second detection result has been corrected by the correction coefficient.

22. The image forming apparatus according to claim 21, wherein the control unit obtains values relating to the toner density, based on a result of subtracting, from a third detection result of detecting normal reflection light reflecting from a position on the rotary member where no detection image is formed by the first detecting unit, a fourth detection result of detecting diffused reflection light reflecting from a position of the rotary member where no detection image is formed by the second detecting unit, the fourth detection result having been corrected by the correction coefficient so as to obtain a correction result, thereby obtaining a second calculation result, and normalizing the first calculation result by the second calculating result.

23. The image forming apparatus according to claim 15, wherein the first light-receiving element receives normal reflection light, and the second light-receiving element receives diffused reflection light.

24. A density detecting device comprising:

a first detecting unit having a first light-receiving element disposed to face a direction of normal reflection of light, the light having been emitted from a first light-emitting element toward a first detection image formed on a rotary member and reflected thereat;

a second detecting unit having a second light-receiving element disposed to face a direction different from a direction of normal reflection of light, the light having been emitted from a second light-emitting element toward a second detection image formed on the rotary member and reflected thereat; and a control unit configured to obtain a value relating to toner density based on correction results of having corrected a first detection result detected by the first detecting unit and a second detection result detected by the second detecting unit.

* * * * *